US009169663B1

(12) United States Patent
Moss

(10) Patent No.: US 9,169,663 B1
(45) Date of Patent: Oct. 27, 2015

(54) METHOD FOR REMEDIATING SMOKE-DAMAGED BRICK VENEER WALL

(71) Applicant: Michael M. Moss, Gallion, AL (US)

(72) Inventor: Michael M. Moss, Gallion, AL (US)

( * ) Notice: Subject to any disclaimer, the term of this patent is extended or adjusted under 35 U.S.C. 154(b) by 0 days.

(21) Appl. No.: 14/276,374

(22) Filed: May 13, 2014

(51) Int. Cl.
*E04B 1/38* (2006.01)
*E04C 1/40* (2006.01)
*E04G 23/02* (2006.01)

(52) U.S. Cl.
CPC ..... *E04G 23/02* (2013.01)

(58) Field of Classification Search
CPC ..... E04G 23/02
USPC ..... 52/513
See application file for complete search history.

(56) References Cited

U.S. PATENT DOCUMENTS 1,541,360 A * 6/1925 Keas et al. ..... 52/681
4,129,972 A 12/1978 Sherman et al.
4,558,552 A * 12/1985 Reitter, II ..... 52/745.19
5,223,272 A * 6/1993 Pringle ..... 425/12
5,322,532 A 6/1994 Kurtz
6,807,786 B1 * 10/2004 Peck ..... 52/514.5
7,662,221 B2 * 2/2010 Fay ..... 106/15.05
8,166,719 B2 * 5/2012 Helton ..... 52/408
8,397,465 B2 3/2013 Hansbro et al.
8,555,583 B2 * 10/2013 Ciuperca ..... 52/309.12
8,621,798 B2 1/2014 Dayton
8,806,825 B2 * 8/2014 Egan et al. ..... 52/411
2006/0010826 A1 * 1/2006 Canteri ..... 52/741.4
2006/0117705 A1 6/2006 Bingham et al.
2009/0193738 A1 8/2009 Kortuem et al.
2010/0041772 A1 * 2/2010 Liversage et al. ..... 514/772.6
2012/0317914 A1 12/2012 Bomberg et al.
2013/0081346 A1 4/2013 Kulprathipanja et al.

FOREIGN PATENT DOCUMENTS

AU 2005202671 A1 1/2006

* cited by examiner

*Primary Examiner* — Joshua J Michener
*Assistant Examiner* — Keith Minter
(74) *Attorney, Agent, or Firm* — Bush Intellectual Property Law; Kenneth M. Bush

(57) ABSTRACT

The present invention relates to a novel brick veneer wall structure, to methods for restoring same after sustaining smoke damage, and to a smoke-damaged brick veneer wall structure restored by a method of the invention.

12 Claims, 5 Drawing Sheets

METHOD FOR REMEDIATING SMOKE-DAMAGED BRICK VENEER WALL

FIELD OF THE INVENTION

The present invention relates generally to the field of building construction and more particularly to methods for remediating smoke damage to a brick veneer wall structure.

BACKGROUND OF THE INVENTION

Every year, smoke and fire damage to residential and commercial properties causes significant loss to property owners and insurance companies. In some instances an entire structure can be destroyed without any possibility of restoring the original structure. When that occurs the only option may be to rebuild the entire structure. In less severe instances, damage is more limited and restoration may be possible. Every occasion of fire damage is unique and must be evaluated for the type and degree of damage from light to very severe damage. Light damage generally occurs without damage to the underlying structure of the building, and may only involve residual smoke deposits such as soot on surfaces, often requiring only external cleaning. Moderate damage encompasses residual deposits, odors, and heat damage to furniture and appliances. Severe damage is more extensive, generally compromising structural components of a building such as the framing.

Many modern buildings and homes are insulated with polymeric foams such as polyurethane. While advantageous from an energy efficiency standpoint, foam insulation can cause severe smoke damage in the event of a fire. Smoke damage in foam-insulated structures can occur very quickly, even when a fire is quickly extinguished. When this happens, the primary damage to a structure may be from the smoke, rather than from the flames of the fire.

Restoring a building or home in the wake of a fire generally involves an appraisal or assessment of the damage by contractors and insurance companies to decide on the most cost-effective way to restore or rebuild the structure.

When a structure damaged by smoke possesses a brick veneer siding, it is standard practice in the industry to demolish the smoke-damaged brick veneer wall and rebuild it, because the inner surface of the brick veneer acts like a sponge that absorbs and then emits obnoxious smoke odors to the surrounding environment including the living space. This is especially the case with foam insulated structures owing to the extensive, high pressure smoke produced by flaming and/or smoldering polymeric foam. Extensive renovations are therefore common practice in cases of smoke-damage to brick veneer wall structures.

There remains a need for improved, lower-cost, brick veneer wall structures that are restored after sustaining smoke damage, and for less costly methods for restoring smoke-damaged brick veneer walls, without the need for a complete demolition of the wall structure.

SUMMARY OF THE INVENTION

The present invention relates to methods for restoring, repairing, or replacing component parts of all or a portion of a smoke-damaged brick veneer wall structure having spaced apart support members that does not include removal or demolition of the brick veneer and structural support members.

The present invention also relates to a previously smoke-damaged brick veneer wall structure or portion thereof that has been restored by a method of the present invention.

The present invention also relates to a previously smoke-damaged and restored brick veneer wall structure or portion thereof comprising a brick veneer, a sealer layer, a baffle member, and an inner layer of insulation material.

The present invention also relates to a novel brick veneer wall structure comprising a brick veneer, sealer layer, baffle member, and inner insulation layer.

Accordingly, it is an object of the present invention to provide a more cost-effective, less labor-intensive method for restoring a smoke-damaged brick veneer wall structure while leaving intact the brick veneer, metal ties or other attachment means, and structural support members.

According to one embodiment of the invention, a house or other building structure having a smoke-damaged brick veneer wall, or region thereof, is restored or remediated by steps that include removing elements of the smoke-damaged wall structure including but not limited to drywall, insulation, and sheathing, while leaving intact the brick veneer, veneer attachment means, and wall studs or other frame support members.

According to another embodiment of a method of the invention, a smoke-damaged brick veneer wall or section thereof is partially demolished leaving the support members, brick veneer, and veneer attachment means intact by steps including soda-blasting the interior side of the brick veneer to abrade away smoke residue and odor therefrom, and applying to the abraded inner surface of the veneer a sealer layer.

According to another embodiment of a method of the invention, a smoke-damaged brick veneer wall or section thereof is partially demolished leaving the support members, brick veneer, and veneer attachment means intact by steps including soda-blasting the interior side of the brick veneer to abrade away smoke residue and odor thereof, applying thereto a sealer layer, and attaching a baffle over the sealer layer to provide adequate air flow.

According to another embodiment of a method of the invention a smoke-damaged brick veneer wall or section thereof is partially demolished leaving the support members, brick veneer, and veneer attachment means intact by steps including soda-blasting the interior side of the brick veneer to abrade away smoke residue and odor thereof, applying to the soda-abraded veneer a sealer layer, attaching a baffle member over the sealer layer to provide air flow, and applying over the baffle member a layer of open-celled foam insulation or batt insulation, and completing the restoration by replacing the interior drywall.

In another embodiment, the present invention relates to a smoke-damaged brick veneer wall structure or portion thereof that has been restored by a method of the present invention.

In another embodiment, the present invention relates to a brick veneer wall structure, or portion thereof, having a structure that comprises a brick veneer, a permeable water sealer, a baffle member, and open-cell foam insulation.

These and other objects and advantages of the present invention will be apparent from the following description, the accompanying drawings, and the appended claims.

DETAILED DESCRIPTION OF THE INVENTION

Figure 1:
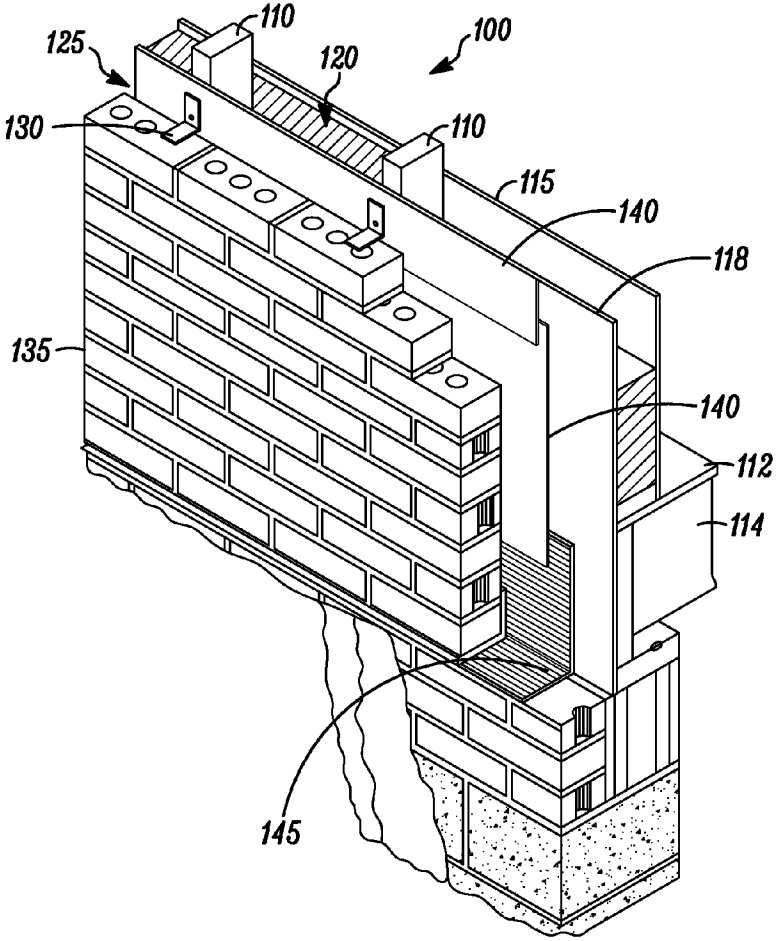
FIG. 1 provides a sectional cut-away view of a standard brick veneer wall structure.

As used herein, the term "brick veneer wall structure" generally refers to a wall structure, or portion thereof, in which a brick veneer is attached, for example, by metal ties or other attachment means to support members or studs of the appurtenant building or house. In one aspect of the present context, some portion or all of a brick veneer wall structure on a house or building has sustained smoke damage from a fire. Generally, a brick veneer wall structure includes interior drywall, insulation between the sheathing and drywall, about a 1 inch gap between the brick veneer and sheathing, for air flow and water drainage, flashing, moisture barriers, etc.

The term "baffle" or "baffle member" or the like is used herein to refer to a component part of a brick veneer wall structure of the present invention which generally is attached to the studs of a structure and is placed between the veneer and an inner layer of insulation, adjacent to the sealer layer on the inner surface of the brick veneer to promote air flow and water drainage.

As used herein the terms "drywall", "gypsum board" and "sheetrock" are used interchangeably to mean a construction material made of a paper liner wrapped around an inner core of gypsum plaster. The plaster is mixed with fiber, plasticizer, foaming agent, finely ground gypsum crystal as an accelerator, EDTA, starch, various additives that increase mildew and fire resistance, wax emulsion and water.

As used herein, the terms "inner" or "interior" or derivatives thereof refer to sidedness of an object, for example, a wall, surface, structure, or other object. When referring to a house or building, it is the side closest to the living or occupation space. Conversely, the terms "outer" or "exterior" refer to the side that is closest to the exterior environment.

As used herein, the term "tie" or "metal ties" refer to a type of attachment member or means for securing or attaching a brick veneer to the remainder of a wall structure to form a brick veneer wall structure, for example, by attaching the brick veneer to the support members or studs.

As used herein, the terms "remediate" or "restore" are used interchangeably and generally refer to restoring to a pristine or pre-damage condition, a brick veneer wall structure that has sustained smoke damage caused by a fire or other source for smoke damage. These terms generally mean to correct, replace, remove, or reduce to acceptable levels, any smoke-related damage to the structure including, but not limited to, degradation, staining, discoloration, residue, and offensive or toxic odors caused by smoke, by cleaning, abrading, blasting, soda-blasting, replacing, or rebuilding damaged wall components including but not limited to drywall, insulation, flashing, sheathing, fasteners, moisture barriers, etc.

The term "remove" or "removal" as used herein may refer to a demolition in which smoke-damaged components of a building wall structure are physically removed from the structure. The term may also refer to the removal or reduction to an acceptable level of non-structural damage such as, for example, smoke residue or soot, and obnoxious odors related to smoke contamination by methods such as surface cleaning, blasting, and/or sealing of component parts and/or replacement thereof.

As used herein, the term "soda-blasting" or "sodablasting" and derivatives thereof, refers to an abrasive method for cleaning a surface or structure, for example, smoke damage from the surface of brick masonry, by spraying under high pressure soda such as sodium bicarbonate or baking soda onto a surface in need thereof.

As used herein, the terms "smoke-damage" or "smoke-damaged" refer generally to any damage to a building or structure or part thereof such as but not limited to a brick veneer wall structure on a residential dwelling resulting from smoke contamination as a result of a fire within or nearby said structure. Smoke damage to a building may include, for example, residue deposits such as ash and soot, and obnoxious and/or toxic odors that may limit or entirely abrogate the livability of the entire structure. Smoke damage may also represent a health risk to occupants.

As used herein, the term "sealer" or "sealer layer" refers to a protective layer applied to the inner surface of a brick veneer, for example, after cleaning the brick veneer of smoke damage including residues and odors, to protect against moisture penetration and to prevent or reduce odor emissions associated with smoke damage. Sealers may include, for example, closed-cell foam insulations, or permeable brick sealer and/or paint.

The term "support member" as used herein refers generally to a structural component of the frame of a house or other type of building and would include, for example, the studs on a wood-framed or other non-wood frame structure.

Embodiments of a method of the present invention provide a cost-effective means to restore a brick veneer wall structure on a house or other building that has sustained smoke damage. An advantage of the present invention is that the restorative method is applied without demolishing the entire wall structure, thereby decreasing the time and cost for remediation. Because demolition of the brick veneer is not required, significant cost-savings can be realized. In preferred embodiments of a method of the invention, components of a smoke-damaged brick veneer wall structure or region thereof are removed without removing the studs or brick veneer. Specifically, embodiments of a method of the present invention involve removing the interior drywall, insulation between the brick veneer and drywall, sheathing, moisture barrier, and any other components that has sustained smoke damage other than the brick veneer, studs, and metal tie or other means that attaches the veneer to the studs.

After a fire and smoke damage to a structure, generally an assessment of the damage would be performed to determine the extent of the damage and steps to remediate. For example, an assessment of interior smoke damage could be made by visual inspection at multiple places of the interior wall structure by removing portions of the drywall.

Embodiments of the present inventive method involve a limited demolition in which brick veneer wall components other than the brick veneer, ties, and studs are removed.

Following limited demolition, the interior side of the brick veneer is cleaned by soda-blasting. Thereafter, the wall structure between the veneer and interior surface of the wall is rebuilt. A first replacement component comprises a sealer layer, generally a closed-cell foam insulation, permeable brick sealer, or paint that is applied over the interior surface of the cleaned brick veneer. Second, an air space is provided between the brick veneer and interior side of the wall by installing a baffle member over the sealer layer. Finally, a layer of open-cell foam insulation or batt insulation is installed over the baffle member. A wall structure remediated according to these steps can then be finished, for example, by applying drywall and paint.

Another embodiment of the present invention relates to a smoke-damaged brick veneer wall structure or portion thereof that has been remediated according to a method of the present invention.

Another embodiment of the present invention relates to a novel structure for a brick veneer wall or portion thereof, comprising a profile, viewed from exterior to interior, of a brick veneer, sealer layer, baffle member, open-cell foam insulation and drywall.

Having briefly described embodiments of the invention, additional aspects of the invention will be provided with reference to the figures and forthcoming discussion.

Remedial Methods and Brick Veneer Wall Structures

FIG. 1 illustrates a sectional view of a typical brick veneer wall structure 100 having an interior drywall layer 115, wall studs 110, sheathing 118, a moisture barrier 140, and a 1-inch air space 125 between the brick veneer 135 and the remainder of the structure. Also illustrated in FIG. 1 are flashing 145, subflooring 112 and floor joists 114. The brick veneer 135 is secured to the studs 110 by means of metal ties 130. The 1-inch air space 125 is designed to ensure proper moisture drainage to reduce or eliminate rain penetration to the sheathing 118 or other backing. Also shown is an inner layer of insulation 120 placed between the studs 110 and the space between drywall 115 and sheathing 118.

Figure 2:
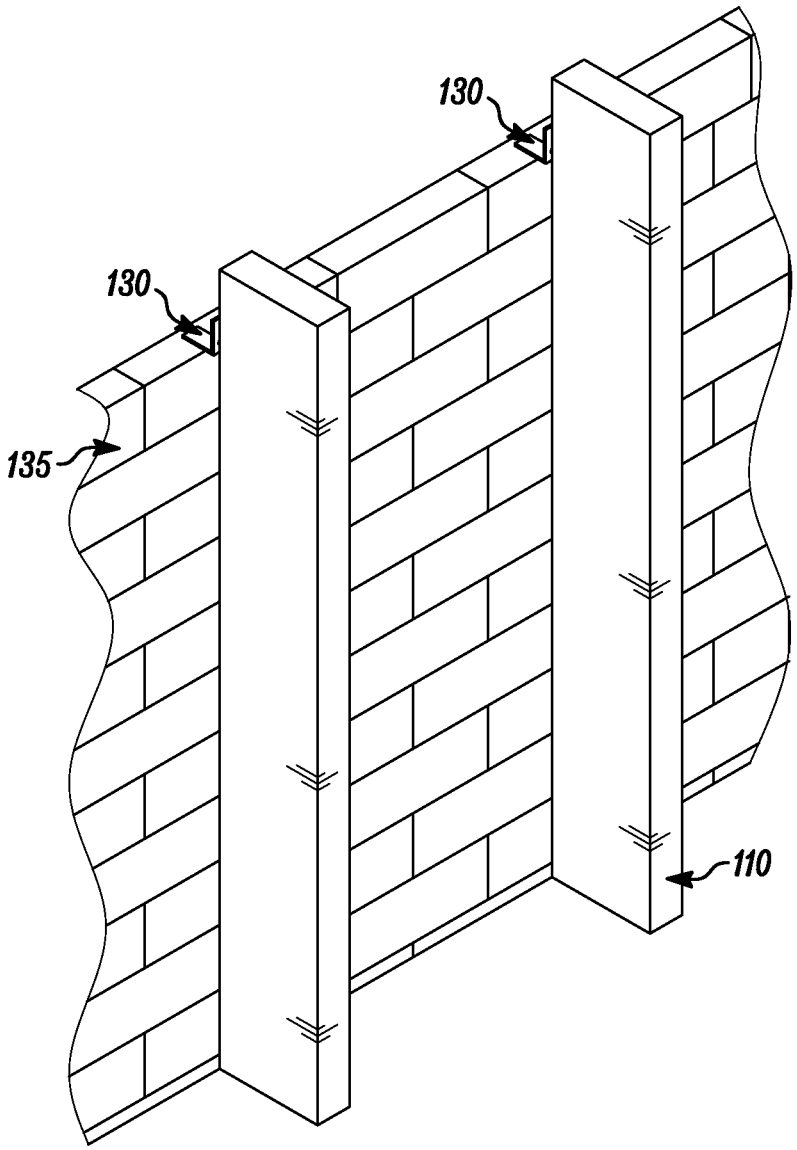
FIG. 2 provides a sectional cut-away view of a region of brick veneer wall that has sustained smoke damage after removal of drywall, insulation and sheathing.

FIG. 2 illustrates a rear perspective view of a brick veneer wall structure after partial demolition according to a method of the invention. FIG. 2 illustrates removal of wall components other than the brick veneer 135, studs 110 and veneer attachment means or metal ties 130. Thus, a method of the present invention leaves the brick veneer 135, studs 110 and metal ties 130 intact while removing the other components of the wall structure that have sustained smoke damage including, for example, drywall, insulation, sheathing, and the moisture barrier.

Figure 3:
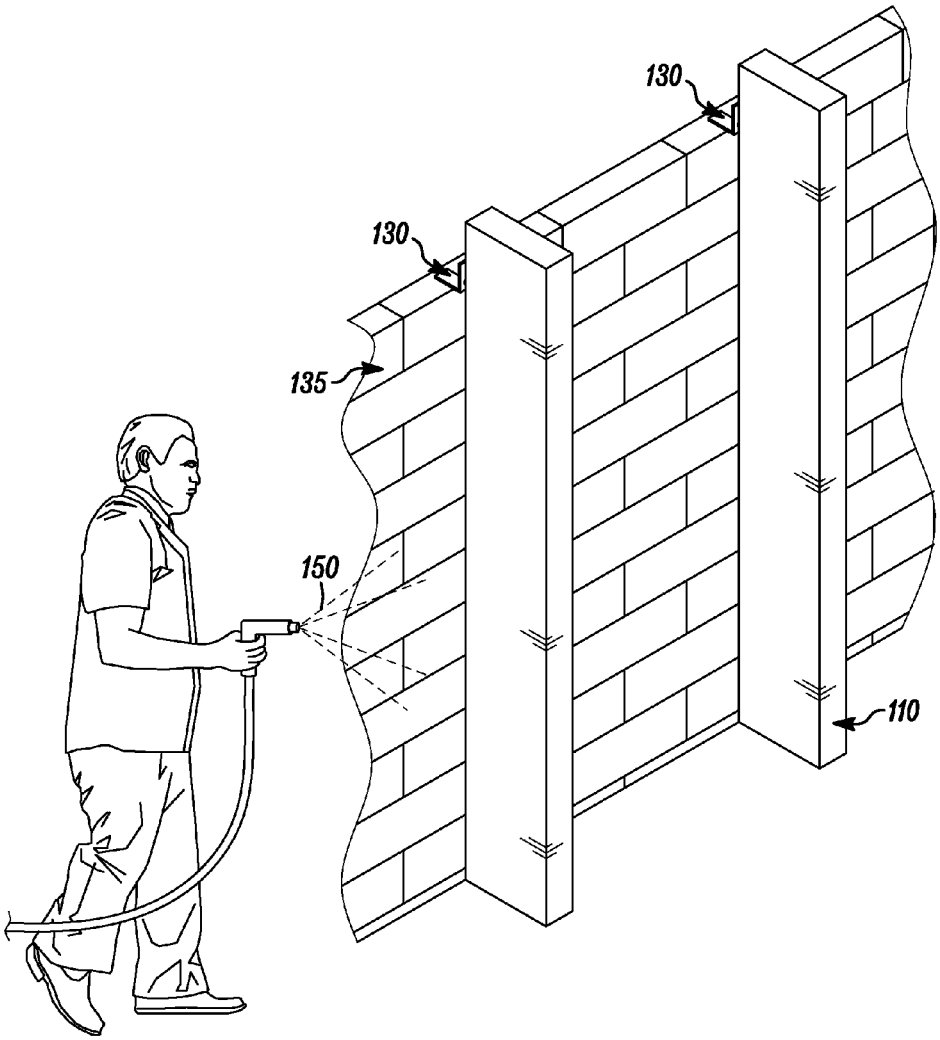
FIG. 3 depicts an aspect of an embodiment of the invention showing a soda-blasting procedure to the interior side of the brick veneer.

FIG. 3 illustrates a rear perspective view of a partially demolished, smoke-damaged brick veneer wall in which the brick veneer 135, studs 110 and metal ties 130 remain intact. FIG. 3 illustrates an aspect of an embodiment of the invention after partial demolition in which an abrasive material is power-sprayed or blasted under high pressure onto the interior surface of the brick veneer 135 as a means to abrade or clean the inner side of the brick veneer of smoke residue, soot, stains, and odors. In a preferred embodiment of this aspect, soda particles are soda-blasted or pressure-sprayed 150 onto the surface of the brick veneer. Suitable soda includes sodium bicarbonate or baking soda that is sprayed with a direct pressure or siphon machine at from about 15 psi to about 90 psi until the brick surface is adequately cleaned.

Figure 4:
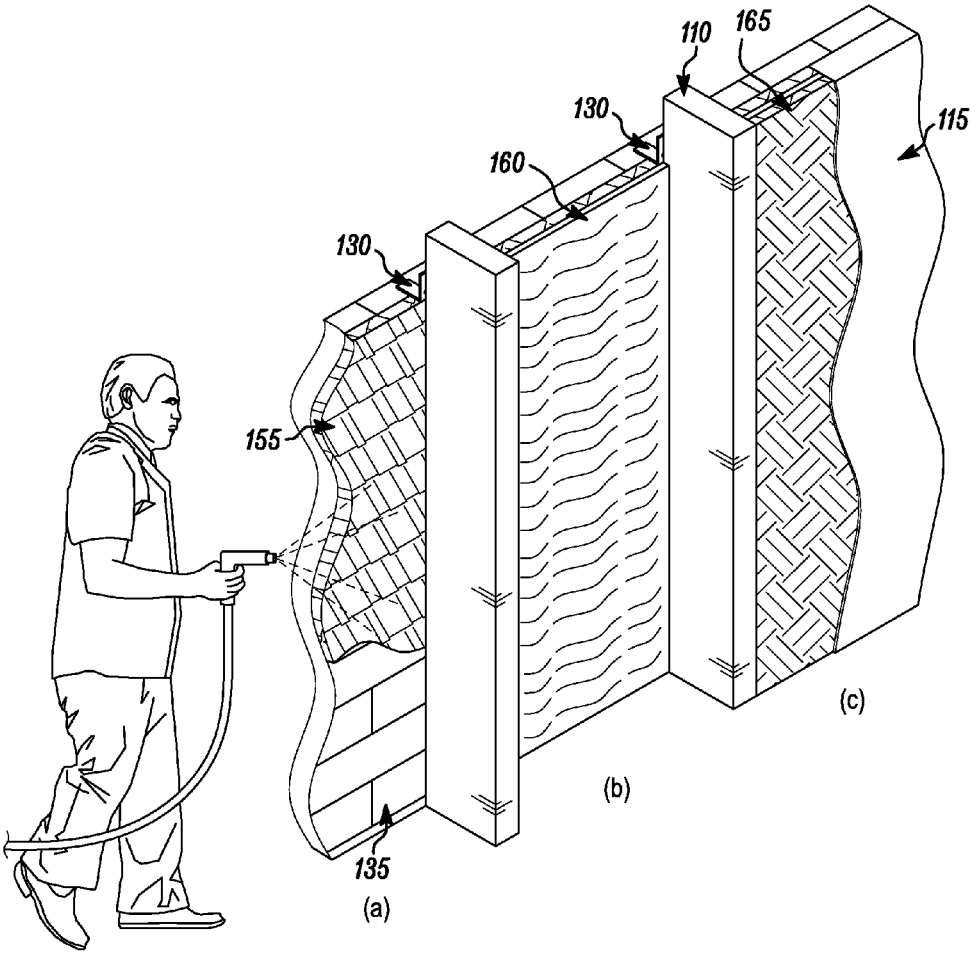
FIG. 4 provides a sectional cut-away view of a region of brick veneer wall displaying various steps in a restoration method according to the present invention. Panel (a) depicts application of closed-cell insulation foam insulation or sealer to the interior side of a soda-blasted brick veneer; panel (b) depicts a baffle structure material that has been applied over the closed-cell insulation or sealer of panel (a); panel (c) depicts open-cell insulation installed over the baffle structure and drywall installed over the open-cell insulation.

FIG. 4 illustrates a rear perspective view of an embodiment of a method of the invention showing a sequence of steps (See Panels (a)-(c)) applied according to a method of the invention to restore a partially demolished brick veneer wall during renovation following smoke damage. Preceding the steps shown in FIG. 4 would be a step to abrade or clean the interior side of the brick veneer preferably by soda-blasting as previously described (FIG. 3). Panel (a) of FIG. 4 shows the application of a sealer layer 155 to the interior side of the soda-abraded brick veneer 135. A suitable sealer layer can be closed-cell foam insulation or a permeable brick sealer or paint. Any suitable closed-cell foam insulation product may be used. Preferably, a spray polyurethane foam is applied to a thickness of about 0.25 inch to about 1 inch; most preferably about 0.5 inch and having a density of about 2 lb. per cubic foot, and an R value of 6 to 6.5 per inch. Suitable closed-cell foam insulations are readily available commercially, for example, HEATLOK SOY 200® PLUS from Demilec USA (2925 Galleria Drive, Arlington, Tex. 76011). The sealer layer 155 acts as a barrier to smoke odor penetration and/or release while at the same time allowing a wet brick veneer to dry from the inside out. If a permeable brick sealer or paint is applied as the sealer layer, suitable commercial sources include, for example, 333-L OmegaSeal from Diedrich Technologies, Inc., 310 Wayto Road, Schenectady, N.Y. 12303; and Benjamin Moore, 101 Peragon Drive, Montvale, N.J.

If the location of the damaged structure is in a geographical area that receives less than about 20 inches of rainfall annually, then a closed-cell foam insulation layer is suitable. However, if the structure is in a location that receives more than about 20 inches rainfall annually, then it is preferred to apply a permeable brick sealer or paint, rather than closed-cell foam insulation as the sealer layer.

Panel (b) of FIG. 4 shows a baffle member 160 applied over, that is adjacent to, the sealer layer 155. Panel (c) shows an interior-facing layer of open-cell foam insulation or batt insulation 165 applied between the baffle member 160 and drywall 115. The interior layer of insulation is generally applied to at least about 3.5 inches or whatever amount is necessary to fill the space around the studs prior to laying drywall. The interior insulation can be, for example, 3.5 inches of R-13 batt insulation, or, preferably, 3.5 inches of open-cell foam insulation for better energy efficiency. Suitable commercial sources for open-cell foam insulation are readily available, for example, Demilec APXTM or SEALECTION® 500, preferably formulated with a fire-retardant.

FIG. 5 depicts the structure of a brick veneer wall structure according to an embodiment of the present invention built de novo, or following smoke damage according to a method of the invention. Differences from a traditional brick veneer wall structure, as depicted in FIG. 1, are apparent. For example, in one aspect, a wall or portion thereof according to the invention does not include sheathing as in the traditional structure. Following partial demolition of a smoke-damaged brick veneer wall according to a method of the present invention, the studs and brick veneer remain intact. Thus, simple replacement of the sheathing is not feasible. In place of sheathing, a method of the invention relies on a sealer layer applied to the inner surface of the brick veneer that acts as a moisture barrier.

Figure 5A:
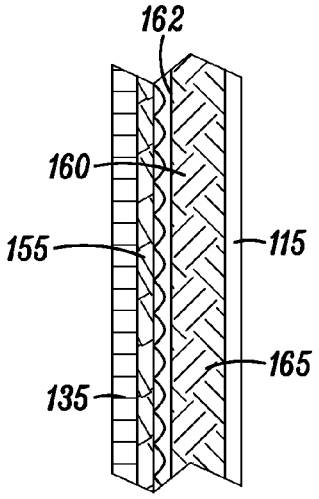
FIG. 5A provides a cross-sectional side view of a brick veneer wall structure built or rebuilt according to the present invention.
Figure 5B:
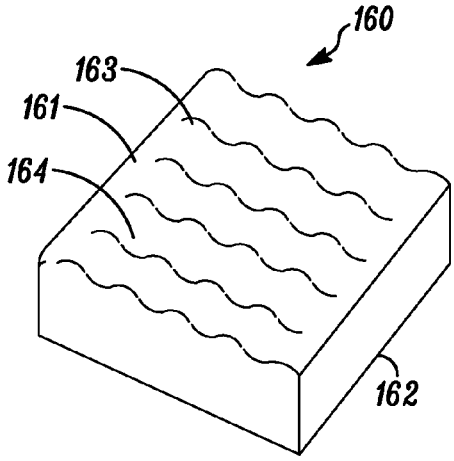
FIG. 5B provides a perspective view of a baffle member having an irregular surface on one side and a flat surface on the other side.
Figure 5C:
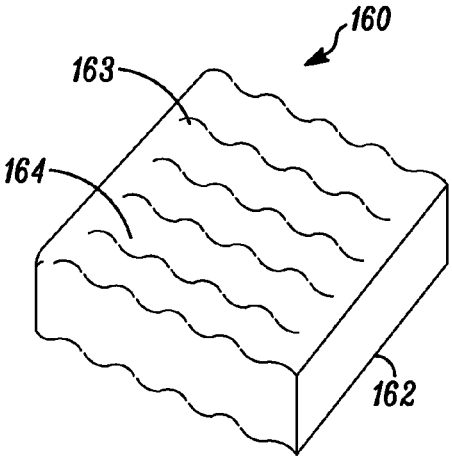
FIG. 5C provides a perspective view of a baffle member having irregular surfaces on both sides.

An additional distinction in a wall structure according to the present invention is that it includes a porous baffle member interposed between the brick veneer and the rest of the wall structure, in place of an open air space as in a traditional brick wall structure (See FIGS. 5A to 5C). The baffle member provides air space to ensure proper air flow and water drainage after rainfall, and drying of the brick from the inside out. Additionally the baffle provides a backing for application of the inner layer of insulation. A baffle member 160 can be made from any suitable material, preferably water-repellant material such as a synthetic foam or Styrofoam panel or membrane. The baffle member preferably has an irregular, undulating or contoured surface on at least one side, for example, rectangular-shaped contours, waffle-shaped contours, egg crate contours, or the like. For example, FIG. 5B shows a baffle member having a flat surface 162 and a dimpled surface structure 161 comprising regularly spaced peaks 163 and valleys 164 as, for example, in an egg-crate or egg-carton. In this embodiment, the irregular, dimpled surface 161 is placed adjacent to or against the sealer layer on the brick veneer, while the flat surface 162 is preferably attached to support members or studs. Attachment of a baffle member to the studs may be, for example, with staples or any suitable construction adhesive. In another embodiment, a baffle member has any type of irregular, peak and valley, surface on both sides of the member (FIG. 5C). Preferably, a baffle member is from about 1 inch to about 1.5 inches in thickness. Suitable baffle products are readily available from commercial sources including those sold as attic ventilation systems or panels, for example, ADO DUROVENT® baffle products (ADO Inc. 1-800-666-8191), or those sold as noise-reduction, acoustical baffles, for example, Egg Crate Foam from Tecnifoam, Inc. (4400 Ball Road NE, Circle Pines, Minn. 55014)

While the form of the method and product herein described constitutes a preferred embodiment of the invention, it should be understood that the invention is not limited to the precise form of apparatus, product or method, and that changes may be made therein without departing from the scope of the invention.

EXAMPLE

Restoration of Brick Veneer Wall after Smoke Damage

A 3000 square foot residential property having a brick veneer wall structure is damaged by a fire and smoke damage. Visual inspection of the wall structure beneath the drywall reveals significant smoke damage throughout the building. The frame of the house is intact. A partial demolition is undertaken to remove drywall, insulation, sheathing, flashing, and moisture barrier without demolishing the brick veneer, studs or metal ties that attach the veneer to the studs of the house. The inner side of the brick veneer is cleaned and treated for smoke damage by soda-blasting using baking soda. After cleaning the inner surface of the veneer, a layer of closed-cell foam insulation HEATLOK SOY 200® PLUS is applied to a thickness of 0.5 inch. Over the closed-cell foam insulation layer is placed a 1.5 inch thick Styrofoam egg crate baffle structure such that the irregular surface of the baffle is placed against the closed-cell insulation layer. The baffle is stapled to studs to hold it in place. Thereafter a layer of open-cell foam insulation having a fire retardant is applied over the baffle structure to a thickness of about 3.5 inches to fill the remaining space between the studs. Finally, drywall is installed and the remediation is completed with interior painting.

The invention claimed is:

1. A method for repairing a smoke-damaged brick veneer wall structure or region thereof, said wall structure having spaced apart support members, comprising the steps of:

a) removing components of the wall structure having smoke damage, other than the brick veneer, support members, and veneer attachment means, said components selected from drywall, insulation, sheathing, moisture barrier, and flashing;

b) cleaning an inner surface area of the brick veneer having smoke damage by soda-blasting, thereby removing smoke residue and/or odor therefrom;

c) applying onto the inner surface of the soda-blasted brick veneer of step (b) a sealer layer; and d) completing the repair to the wall structure;

e) wherein said completing step (d) comprises mounting next to the sealer layer of step (c), a porous baffle member to promote air flow around said brick veneer, said baffle member having at least one irregular surface that is in contact with said sealer layer;

f) wherein said completing step (d) further comprises applying to the interior-facing surface of said baffle member an interior layer of insulation selected from open-cell foam insulation and batt insulation;

g) wherein said completing step (d) further comprises replacing drywall over said interior layer of insulation.

2. The method of claim 1 wherein said sealer layer is selected from closed-cell foam insulation, permeable brick sealer, or paint.

3. The method of claim 2 wherein said sealer layer is closed-cell foam insulation applied to a thickness of from about 0.25 inch to about 1 inch.

4. The method of claim 3 wherein said baffle member is attached to support members by stapling or by adhesive.

5. The method of claim 4 wherein the irregular surface of said baffle member has an egg-carton surface structure and a thickness of about 1 inch to about 1.5 inches.

6. The method of claim 5 wherein said interior layer of insulation is open-cell foam insulation about 3 inches to about 4 inches in thickness.

7. A method for repairing a smoke-damaged brick veneer wall structure, said wall structure comprising a brick veneer wall having an exterior surface and an interior surface and a plurality of spaced apart support members secured to said interior surface of said veneer wall, said method comprising the steps of:

a) removing components of said wall structure having smoke damage other than said brick veneer wall and said support members secured thereto;

b) pressure-spraying said interior surface of said brick veneer wall with soda particles to remove smoke residue and odor therefrom;

c) applying a sealer layer onto said interior surface of said brick veneer wall after said pressure-spraying step to prevent residual odor from the smoke damage from being released from said interior surface of said brick veneer wall; and d) completing the repair to said wall structure;

wherein said completing step (d) comprises mounting a porous baffle member adjacent said sealer layer after said sealer layer applying step to promote air flow around said sealer layer, said baffle member having an irregular surface adjacent said sealer layer;

wherein said completing step (d) further comprises applying an insulation layer adjacent said baffle member after said baffle member mounting step, said insulation layer selected from open-cell foam insulation and batt insulation.

8. A method according to claim 7, wherein said baffle member is attached to said support members by stapling or adhesive.

9. A method according to claim 7, wherein said completing step further comprises attaching drywall adjacent said insulation layer after said insulation layer applying step.

10. A method according to claim 7, wherein said insulation layer is open-cell foam insulation about 3 inches to about 4 inches in thickness.

11. A method according to claim 7, wherein said sealer layer is selected from closed-cell foam insulation, permeable brick sealer, or paint.

12. A method according to claim 7, wherein said sealer layer is closed-cell foam insulation applied to a thickness of from about 0.25 inch to about 1 inch.

* * * * *